United States Patent [19]

Allen

[11] Patent Number: 4,731,741

[45] Date of Patent: Mar. 15, 1988

[54] BULK MAIL LABEL PRINTING

[76] Inventor: Paul M. Allen, 2224 Main St., Little Rock, Ark. 72206

[21] Appl. No.: 791,449

[22] Filed: Oct. 25, 1985

[51] Int. Cl.[4] ..... B07C 7/00

[52] U.S. Cl. ..... 364/518; 209/3.3

[58] Field of Search ..... 364/518, 519; 209/900, 209/559, 3.3, 584

[56] References Cited

U.S. PATENT DOCUMENTS

| | | | |
|---|---|---|---|
| 4,117,975 | 10/1978 | Gunn | 209/3.3 |
| 4,167,476 | 9/1979 | Jackson | 209/584 |
| 4,601,394 | 7/1986 | Hutner | 209/900 |

*Primary Examiner*—Arthur G. Evans

*Attorney, Agent, or Firm*—Cushman, Darby & Cushman

[57] ABSTRACT

A bulk mail list is produced in which all the address entries in the list are in order by bundle, with separators providing an indication of the divisions between bundles. Utilizing a computer and printer, a bulk mail sorted list of address labels is automatically produced. The zipcode, city, and state of each address entry in a random address file is entered into the computer, and the computer automatically sorts all of the address entries in the file according to bulk mail criteria. That is (for a third class mailing) all entries ten or more in number having the same zipcode are provided in a bundle, each ten or more entries having the same city of multi-zipcode cities are provided in a bundle, all entries of ten or more having the first three digits of the zipcode the same are provided in a bundle; all entries of ten or more having the same state designation are provided in a bundle; and any remaining entries are in a mixed state bundle. The address file must contain at least 200 hundred entries. The separator labels that are printed between each bundle sequence of labels preferably includes a designation of the bundle code (e.g. "D", "3", "S", or "C") of the entries in the following bundle, and the number of labels (particularly if 50 or more) in the previous bundle.

18 Claims, 7 Drawing Figures

Fig. 5
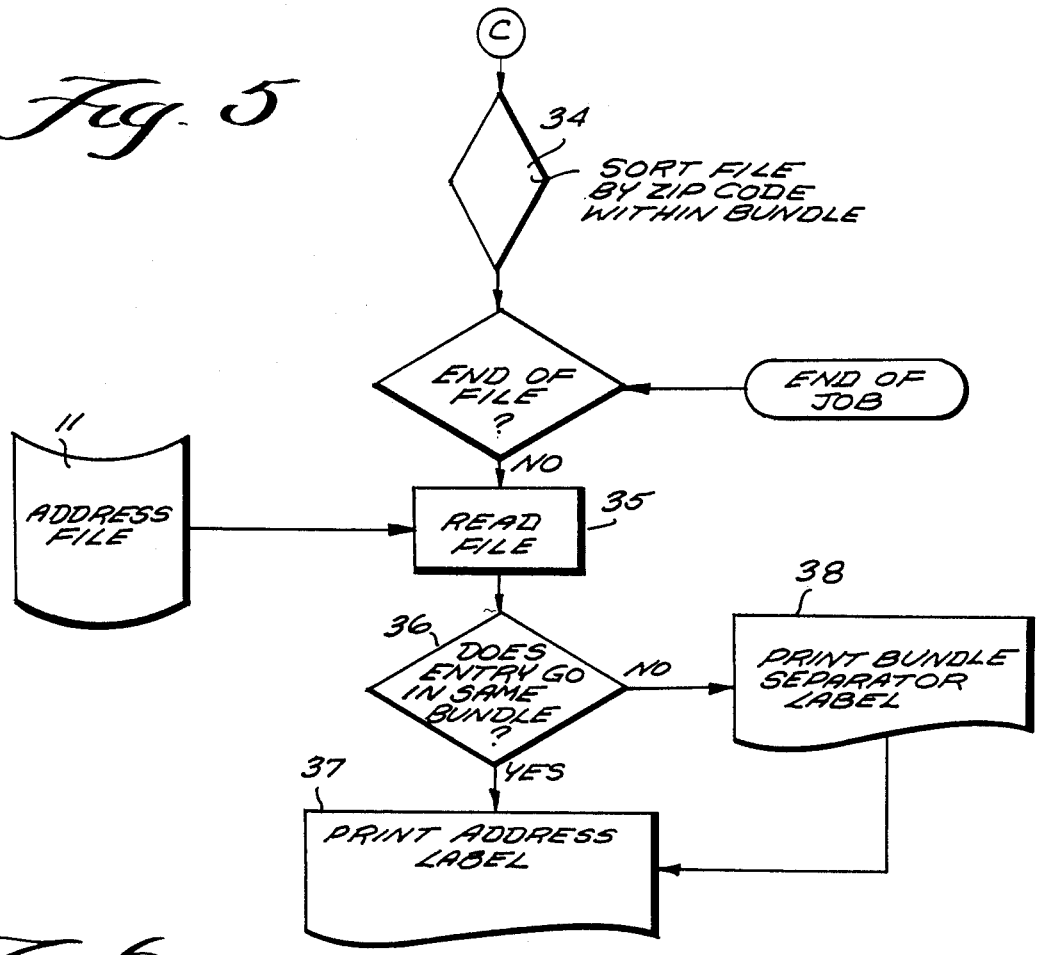
Fig. 6
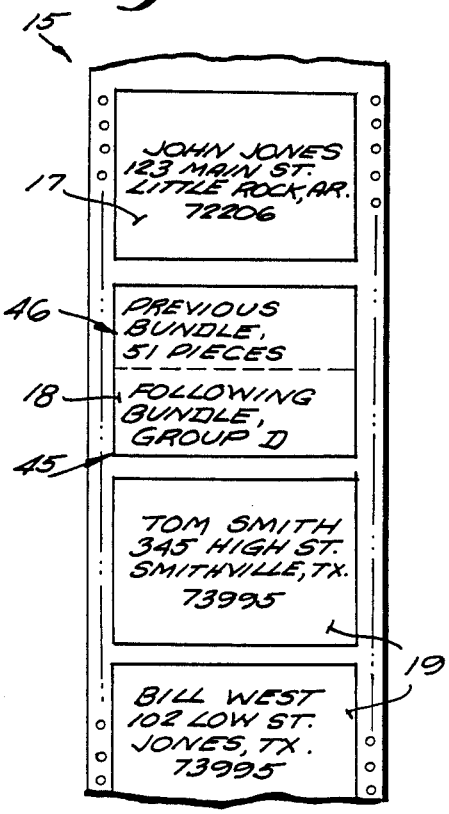
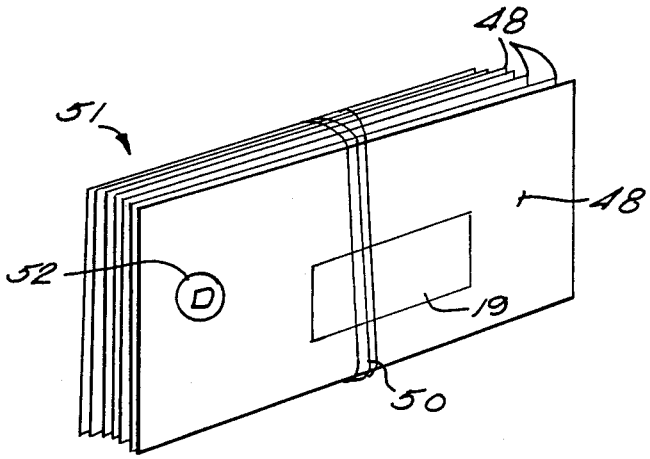
Fig. 7

BULK MAIL LABEL PRINTING

BACKGROUND AND SUMMARY OF THE INVENTION

Organizations that must necessarily mail a large number of pieces to all the addresses within an address file, utilize bulk mail rates in order to achieve cost savings. Typically, bulk mail rates are almost 50 percent less than first class rates. However in order to qualify for such rates, the organization doing the mailing must separate the pieces of mail according to a number of predetermined criteria. The bundle criteria presently utilized by the Post Office are: five digit zipcode; city designation (for multi- zipcode cities); sectional designations (typically the first three digits of the zipcode); state designations; and a mixed state bundle containing all the pieces not falling into previous bundles. For each ten or more pieces falling within each of the previously recited criteria for third class mailing, or for each six or more pieces falling within the previously set forth criteria for second class mailing, a separate bundle is defined. The five digit zipcode designation criteria takes precedence over the others, and then, in order, the city designation, sectional designation, and state designation.

The bundles that are transmitted to the Post Office to qualify for the bulk mail rate must comprise, in total, at least 200 pieces. Also, each bundle must have a sticker on the first piece thereof indicating which of the criteria set forth above it corresponds to. If the bundle is one containing all pieces having the same five digit zipcode, then a sticker with the indicia "D" thereon is applied to the first piece. Where all the pieces in the bundle have the same city, sectional, or state designation, the first piece has a sticker with the indicia "C", "3", or "S", respectively. The mixed state bundle typically has no indicating sticker. Further, if there are 50 or more pieces within any bundle, then that bundle even a better rate.

Prior to the invention, separation of pieces of mail into bulk mail bundles has typically been performed manually. After labels have been applied to the mail (which labels contain each of the necessary designations to determine which bulk mail criteria they fall into), the pieces are manually sorted. Another common technique has been to manually determine what bundle each piece goes into, and code each address record as such so that a computer printed address labels ultimately appear in bulk mail sequence. One procedure typical of this approach is shown in U.S. Pat. No. 4,117,975. Prior to the invention, no procedure has been provided that allows automatic determination of bulk mail sequence from entries in a random address file, or the existence of a mail list pre-sorted to bulk mail sequence. The invention provides such a method and list.

According to the present invention, a method is provided for automatically producing a bulk mail sorted list of address labels utilizing a computer and a printer. According to the method of the invention, the address file is automatically acted upon so that the necessary sorting to bulk mail sequence is provided, and then the computer automatically controls the printer to print a sequence of labels wherein all the labels within a given bundle are in sequence, with a separator disposed between labels in different bundles. The separator bundle typically will have thereon indicia indicating what type of bundle the following bundle is (e.g. a "D" bundle, etc.), and also preferably has an indication of the number of pieces in the previous bundle, particularly where this number is 50 or greater so that the operator may be sure to take advantage of the additional discount provided for bundles with 50 or more pieces. The labels are applied to "envelopes" containing the material to be mailed, and the pieces within each bundle are affixed together with the appropriate sticker (e.g. "D") applied to the first piece in the bundle.

The invention also contemplates a direct mail list having more than 200 address entries, the list in order by bundle (that is presorted according to bundle), with appropriate indicators provided at divisions between bundles.

It is the primary object of the present invention to automatically effect the sorting and printing of labels in bulk mail sequence, of address entries in a random address file. This and other objects of the invention will become clear from an inspection of the detailed description of the invention, and from the appended claims.

BRIEF DESCRIPTION OF THE DRAWINGS

FIGS. 3 through 5 contain a more detailed exemplary flow chart of the relevant portions of a suitable computer program utilized in controlling the apparatus of FIG. 1 in order to obtain the desired results;

FIG. 6 is a schematic plan view of a sequence of printed labels according to the present invention; and FIG. 7 is a perspective view of a number of pieces of mail within a particular bundle, the pieces within the bundle having been determined automatically according to the method of the present invention.

DETAILED DESCRIPTION

Figure 1:
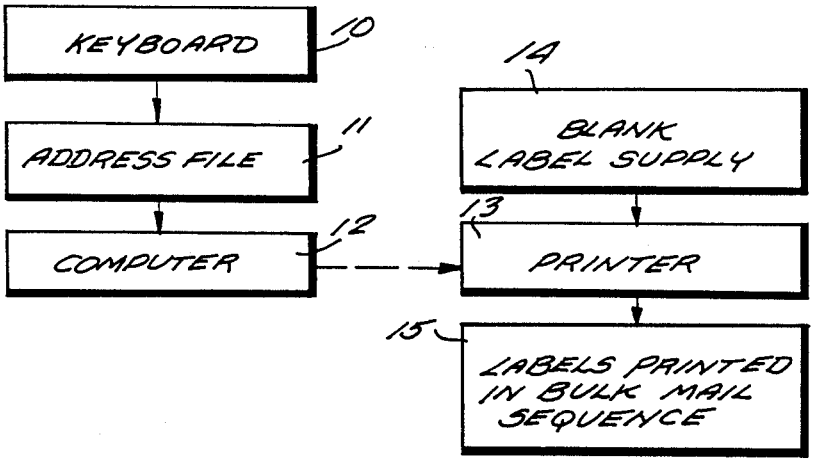
FIG. 1 is a block diagram indicating exemplary apparatus utilizable in practicing the method of the present invention.

FIG. 1 schematically illustrates conventional exemplary apparatus that may be utilized for the practice of the present invention. Utilizing a conventional keyboard 10, or other means for inputting a random address file 11 into a computer 12, the address file 11 is inputted into the memory of the computer 12. Each entry within the address file 11 contains city, state, and zipcode designations. The computer 12 preferably comprises an IBM PC, or a like compatible computer. The computer 12 contains all of the circuitry, control, and memory elements necessary in order to practice the invention.

The computer 12 controls a conventional automatic printer 13. The printer 13 typically is fed with labels from a blank label supply 14. The output of the printer 13 is a plurality of labels that have been printed in bulk mail sequence, as indicated by reference numeral 15. Separator labels are disposed between the printed labels.

A schematic showing of a sequence of labels 15 according to the present invention is illustrated in FIG. 6. In FIG. 6 only four labels are shown, however it is to be understood that the plurality of labels in output 15 will include at least 200 address labels, with appropriate separator labels.

The label 17 in FIG. 6 is one of a first bundle or sequence of labels, which will include at least ten labels (for third class mailing, six or more for second class mailing), in this case sorted according tc ɜipcode. A separator label 18 is provided, and then following the separator label 18 are a plurality of labels 19 which are in the next, following, bundle, this bundle also sorted according to zipcode. Again, there would be at least six labels 19 in this bundle.

Figure 2:
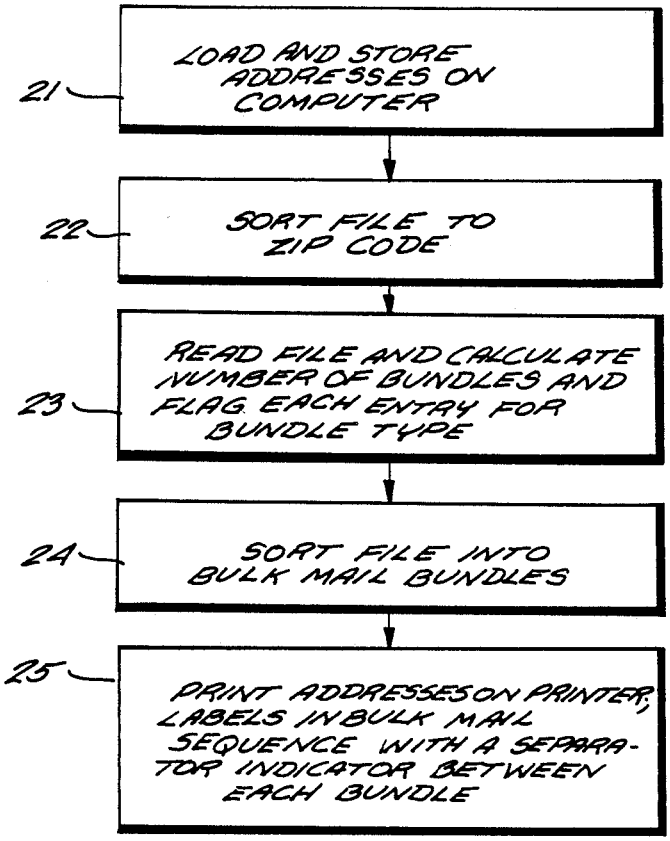
FIG. 2 is a basic exemplary flow chart indicating the steps performed in the practice of the method according to the present invention.

FIG. 2 provides a basic flow chart indicating the steps utilized in the practice of the present invention. The first step, 21, illustrated in FIG. 2 is the loading and storing of the address file 11 in the computer 12. This can be done, as previously described, utilizing the keyboard 10. Alternatively, the random address file 11 may be optically read into the memory of the computer 12, etc.

Once the address file 11 is in the computer 12, the computer sorts the file entries by zipcode, as illustrated by step 22 in FIG. 2. Subsequently, the computer, as illustrated by step 23 in FIG. 2, reads the file and calculates the number of bundles and flags each entry for bundle type. Then, the computer automatically performs step 24 in which the file is sorted into bulk mail bundles. Subsequently, as illustrated at step 25 in FIG. 2, the computer controls the printer 13 to print addresses on labels in a bulk mail sequence, with a separator (18) between each bundle, the final labels produced illustrated by reference numeral 15 in FIGS. 1 and 6.

After the practice of the steps of FIG. 2, the address labels are ultimately applied to "envelopes" containing the material to be mailed. While the term "envelope" is used in the specification and claims, this term should be interpreted more broadly than is conventional, to include not only separate paper mailing structures, but also to encompass the application of labels directly onto pieces of mail that do not require any separate packaging.

Figure 3:
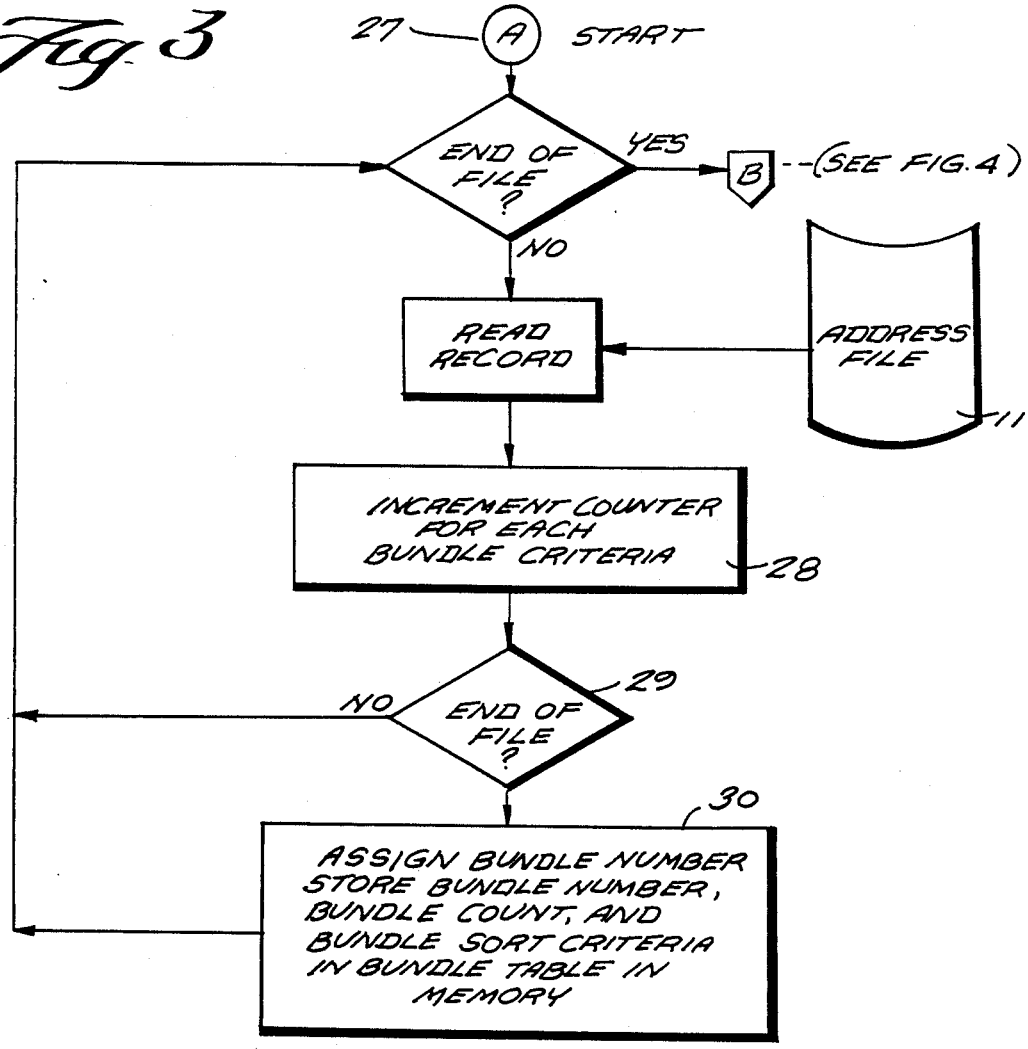
Figure 4:
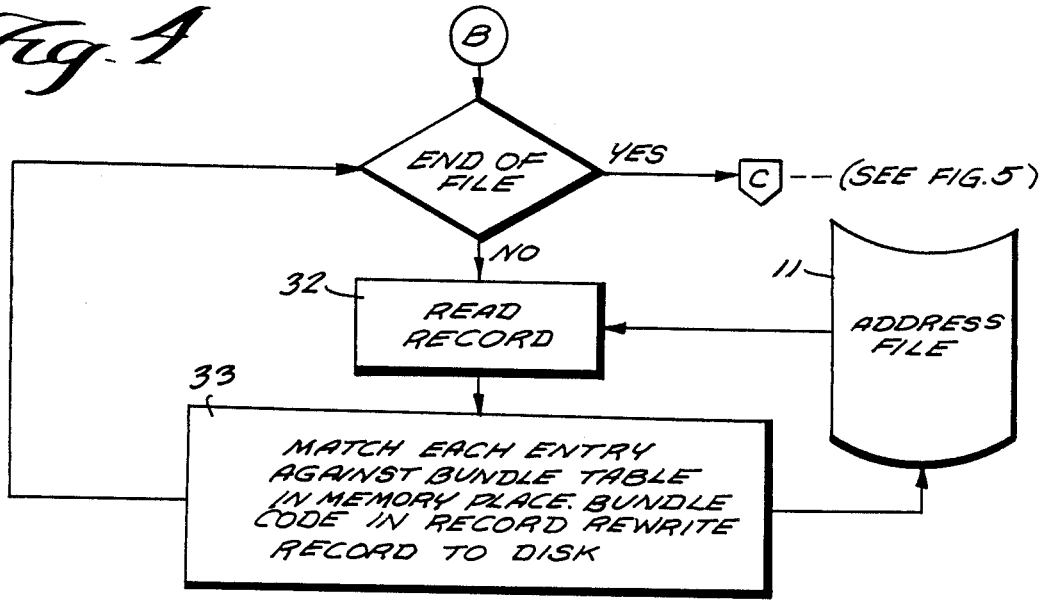

FIGS. 3 through 5 provide an outline of the relevant program instructions that are provided to the computer 12 in order that it will function to practice the method according to the present invention.

The start 27 in FIG. 3 assumes that the random address file 11 has already been entered into the computer 12. In step 28, a counter within the computer 12 is incremented for each bundle criteria. The bundle criteria are zipcode, city (for a multi-zipcode city), sectional (first three digits of the zipcode), and state designations. Once the minimum number of entries (e.g. 10 ) of a bundle for any bundle criteria has been counted, then the counts for these particular entries are substracted from the counts for the other bundle criteria. When all the entries for a particular bundle, conforming to a bundle criteria, have been reached, at end of bundle step 29, then in step 30 a bundle number is assigned, the bundle number is stored in the computer's memory, a count is made of the address entries within the bundle and this is compared to the bundle sort criteria in a bundle table in the computer's memory. At the end of the file, processing continues as indicated in FIG. 4.

In FIG. 4, the record is read in step 32, and at step 33 each entry is matched against the bundle table in memory pursuant to step 30. A bundle code is then placed in the record.

The procedure continues in FIG. 5, wherein at decision step 34 the file is sorted by zipcode within a bundle code. Again the entries are read at step 35, and at decision step 36 an evaluation is made as to whether or not a particular entry goes into the same bundle as the previous one. The printer 13 is used to print out the address labels at step 37, with the bundle separator labels being printed out at step 38.

A typical bundle separator label is illustrated schematically at 18 in FIG. 6. The separator label 18 will preferably have on it indicia indicating what group the labels in the following bundle fall into. For the particular example illustrated in FIG. 6, this indicia 45 indicates that the following bundle is sorted according to zipcode, thus group "D".

The separator label 18 illustrated in FIG. 6 also includes indicia 46 thereon indicating a count of the number of labels in the previous bundle (including label 17). This indicia is particularly desirable where the previous bundle has 50 or more pieces, since a discount can be obtained for that bundle.

After printing of the label series 15, the labels are applied to envelopes of pieces of mail. Then the pieces of mail within any particular bundle are attached together. For instance as seen in FIG. 7, a label 19 has been applied to the outside of an envelope 48. All the other envelopes 48 from the predetermined "bundle" of labels also have labels 19 on the outside thereof. After all the labels 19 have been applied to envelopes 48, they are packaged or bundled together into bundle 51, as by disposing a rubber band 50 around them. As indicated by the indicia 45, the pieces in this bundle have been sorted according to zipcode, thus on the first envelope 48 in the bundle 51, a sticker 52, having the indicia "D" thereon is provided. The bundle 51 is then taken to the Post Office for bulk mailing.

It will thus be seen that according to the present invention a method is practiced for automatically producing a bulk mail sorted list of address labels. The method is practiced by the steps of: (a) automatically reading the entries in a random address file to determine the following bundle criteria for each entry: complete zipcode; city; state; and first digits of, but not the complete, zipcode; (b) automatically incrementing a counter for each bundle criteria; (c) after completing steps (a) and (b) for all entries, automatically assigning a bundle number for each entry, storing the bundle numbers, and conducting a bundle count for each bundle sort criteria to construct a bundle table in the computer memory; (d) automatically comparing the bundle table of step (c) to each address entry in the file; (e) automatically separating the address entries into bundles so that each bundle is sorted according to one of the bundle criteria set forth in step (a), or is in a miscellaneous group, and a minimum number of pieces for each bundle criteria are within each bundle; and (f) automatically controlling the printer so as to print labels in the sequence set forth in step (e) so that all the labels within a bundle are printed in sequence.

It is to be understood that while the invention has been described with respect to the present criteria for bulk mailings, it is equally applicable to changes made by the Post Office. For instance by simple changes to the program and change in the number of pieces to fit within each bundle criteria, change of bundle criteria (e.g. to 9 digit zipcode), change of total number of pieces to qualify for bulk mail rates, and the like, may be readily accommodated.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and products.

What is claimed is:

1. A method of automatically producing a bulk mail sorted list of address labels utilizing a computer and a printer, comprising the steps of:

(a) entering a random address file having at least L address entries into the computer memory, the address file having, for each address entry, city, state, and zipcode designations;

(b) automatically sorting all the address entries in the address file by zipcode, by partial zipcode, by multiple zipcode cities, and by state, designations;

(c) automatically separating out all address entries in the address file having X or more address entries with the same zipcode, and assigning a bundle number to each;

(d) automatically separating out any remaining address entries, after step (c), having Y or more address entries with the same multi-zip city designation, and assigning a bundle number to each;

(e) automatically separating out any remaining address entries, after step (d), having Z or more address entries with the partial zipcode, and assigning a bundle number to each;

(f) automatically separating out any remaining address entries, after step (e), having K or more address entries with the same state designation, and assigning a bundle number to each;

(g) automatically assigning a bundle number to any additional entries remaining after step (f); and (h) automatically controlling the printer with the computer to print a sequence of labels wherein all labels in each bundle number are printed in sequence, and to print a separator between labels of different bundle number.

2. A method as recited in claim 1 wherein step (h) is practieed so as to print on each separator a bundle code indicating what type of bundle follows the separator.

3. A method as recited in claim 2 wherein step (h) is further practiced so that the bundle code printed on separators is selected from the group consisting essentially of "D", "3", "S", and "C".

4. A method as recited in claim 3 comprising the further steps of: applying the printed labels to envelopes containing material to be bulk mailed, one label being applied to each envelope; each time a separator label is reached, bundling together all of the envelopes, with applied labels, prior to the separator label and, if necessary, applying a sticker thereto having the bundle code designation appearing on the separator label before the bundle; and repeating these steps until all of the labels have been applied to envelopes, and the envelopes bundled.

5. A method as recited in claim 4 wherein step (h) is further practiced by printing on each separator label the number of labels in the previous bundle.

6. A method as recited in claim 1 wherein L is 200, and wherein X, Y, Z, and K are each positive integers, that may or may not be the same, greater than, or equal to, six.

7. A method as recited in claim 6 wherein X, Y, Z, and K are each equal to ten.

8. A method as recited in claim 1 wherein step (h) is practiced so as to print on each separator label the number of labels in the previous bundle if that number is greater than or equal to 50.

9. A method as recited in claim 1 comprising the further step of applying the labels between each set of separators to envelopes containing material to be bulk mailed, and bundling together all such envelopes.

10. A method as recited in claim 9 comprising the further step of, for each bundle of envelopes, applying, if appropriate, a sticker to the first piece of the bundle, the sticker indicating the nature of the commonality of address entries on the labels of the bundle.

11. A method as recited in claim 10 wherein the stickers to be applied, where appropriate, to the first piece of each bundle include indicia selected from the group consisting essentially of "D", "3", "S", and "C".

12. A method of automatically producing a bulk mail sorted list of address labels utilizing a computer and a printer, comprising the steps of:

(a) loading and storing a random address file, having at least 200 address entries, into the computer's memory, and for each entry of the address file entering the city, state, and zipcode designations of the entry;

(b) with the computer, automatically sorting the address file according to zipcode;

(c) utilizing the computer, automatically reading the file and calculating the number of bundles, and flagging each entry for bundle type;

(d) with the computer, automatically sorting the file entries into bulk mail bundles; and (e) utilizing the computer, controlling the printer to print address labels in bulk mail sequence so that all labels within a particular bundle are in sequence, and automatically disposing a separator between each bulk mail bundle of labels.

13. A method as recited in claim 12 comprising the further step of applying the labels between each set of separators to envelopes containing material to be bulk mailed, and bundling together all such envelopes.

14. A method as recited in claim 13 comprising the further step of, for each bundle of envelopes, applying, if appropriate, a sticker to the first piece of the bundle, the sticker indicating the nature of the commonality of address entries on the labels of the bundle.

15. A method of automatically producing a bulk mail sorted sequence of address labels utilizing a computer and a printer, wherein disposed within the computer memory is a random address file having at least L entries, and each entry in the file having city, state, and zipcode designations, comprising the steps of:

(a) automatically reading the entries in the address file to determine the following bundle criteria for each entry: complete zipcode; city; state; and first digits of, but not the complete, zipcode;

(b) automatically incrementing a counter for each bundle criteria;

(c) after completing steps (a) and (b) for all entries, automatically assigning a bundle number for each entry, storing the bundle numbers, and conducting a bundle count for each bundle sort criteria to construct a bundle table in the computer memory;

(d) automatically comparing the bundle table of step (c) to each address entry in the file;

(e) automatically separating the address entries into bundles so that each bundle is sorted according to one of the bundle criteria set forth in step (a), or is in a miscellaneous group, and a minimum number of pieces for each bundle criteria are within each bundle; and (f) automatically controlling the printer so as to print labels in the sequence set forth in step (e) so that all the labels within a bundle are printed in sequence.

16. A method as recited in claim 15 wherein step (f) is practiced so as to print a separator between each sequence of labels comprising a bundle, so that the end of one bundle and start of another bundle is readily discerned.

17. A method as recited in claim 15 comprising the further step of applying the labels between each set of separators to envelopes containing material to be bulk mailed, and bundling together all such envelopes.

18. A method as recited in claim 17 comprising the further step of, for each bundle of envelopes, applying, if appropriate, a sticker to the first piece of the bundle, the sticker indicating the nature of the commonality of address entries on the labels of the bundle.

* * * * *